US006994223B1

(12) United States Patent
Edgar, II et al.

(10) Patent No.: US 6,994,223 B1
(45) Date of Patent: Feb. 7, 2006

(54) DIAGNOSTIC READOUT FOR OPERATION OF A CRANE

(75) Inventors: Robert A. Edgar, II, Tulsa, OK (US); Randall J. Nobles, Sand Springs, OK (US)

(73) Assignee: Auto Crane Company, Tulsa, OK (US)

( * ) Notice: Subject to any disclaimer, the term of this patent is extended or adjusted under 35 U.S.C. 154(b) by 141 days.

(21) Appl. No.: 10/282,343

(22) Filed: Oct. 29, 2002

(51) Int. Cl.
*B66C 15/00* (2006.01)

(52) U.S. Cl. ..... 212/270; 212/278

(58) Field of Classification Search ..... 212/270, 212/278

See application file for complete search history.

(56) References Cited

U.S. PATENT DOCUMENTS 4,006,347 A * 2/1977 Hohmann ..... 701/124
4,119,118 A * 10/1978 Patel ..... 137/594
4,222,491 A * 9/1980 Geppert ..... 212/278
4,787,524 A 11/1988 Cobb, III et al.
4,815,614 A * 3/1989 Putkonen et al. ..... 212/272
4,959,721 A * 9/1990 Micic et al. ..... 348/734
5,201,629 A * 4/1993 Simpson et al. ..... 414/632
5,240,129 A 8/1993 Schrick et al.
5,730,305 A * 3/1998 Ichiba et al. ..... 212/276
5,731,987 A * 3/1998 Strong et al. ..... 700/302
6,131,750 A 10/2000 Harrington
6,170,681 B1 * 1/2001 Yoshimatsu ..... 212/278
6,341,665 B1 1/2002 Zhou et al.
6,357,132 B1 3/2002 Banks
6,378,653 B1 4/2002 Takahashi
6,493,616 B1 * 12/2002 Rossow et al. ..... 701/29
6,546,724 B2 * 4/2003 Nishimura et al. ..... 60/431
6,553,278 B2 * 4/2003 Handroos et al. ..... 700/213
6,718,245 B2 * 4/2004 Watanabe et al. ..... 701/50
6,782,644 B2 * 8/2004 Fujishima et al. ..... 37/348

OTHER PUBLICATIONS

JLG Industries, Web Page, Oct. 3, 2002—3 pages.
Kar-Tech Versa Remote Control System—Operations and Installation Manual (Preliminary), Dec. 14, 2001.
Kar-Tech Products: Radio Remote, Internet Printout (2 pages).
Kar-Tech Products: VCAN, Palm Pilot (1 page).

* cited by examiner

*Primary Examiner*—Thomas J. Brahan
(74) *Attorney, Agent, or Firm*—Roger N. Chauza; Chauza & Handley, LLP

(57) ABSTRACT

A programmable control system for a crane that senses a hydraulic pressure of the lift mechanism, and controls the movements of the crane apparatus as a function of the magnitude of the hydraulic pressure. As the status conditions of the crane change, sense switches relay such information to a programmable controller and error codes are generated and presented to the operator. The control system can respond to the states of the sense switches and override wireless command inputs to the control system.

16 Claims, 9 Drawing Sheets

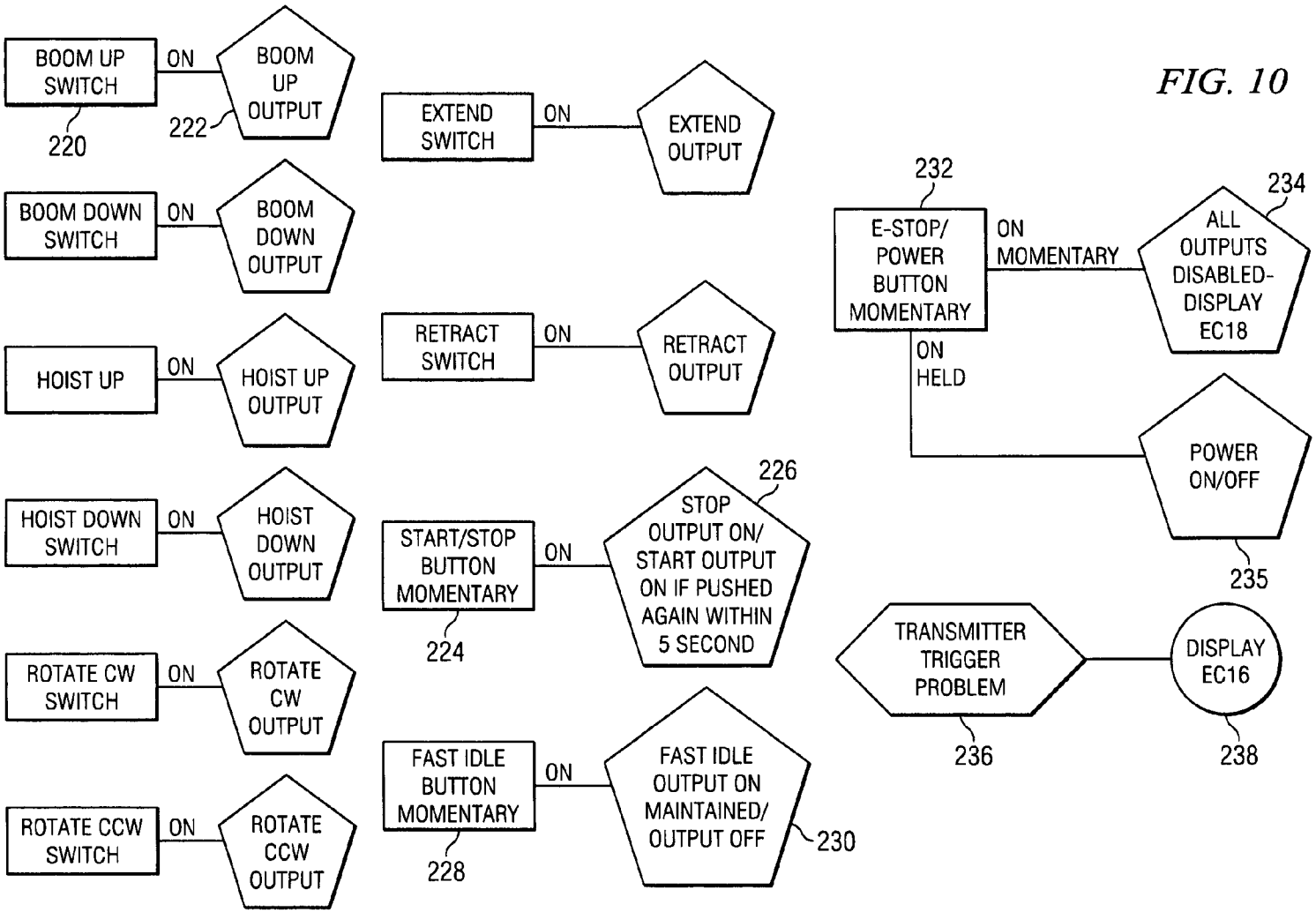
FIG. 10
BOOM UP SWITCH
220
ON
BOOM UP OUTPUT
222
BOOM DOWN SWITCH
ON
BOOM DOWN OUTPUT
HOIST UP
ON
HOIST UP OUTPUT
HOIST DOWN SWITCH
ON
HOIST DOWN OUTPUT
ROTATE CW SWITCH
ON
ROTATE CW OUTPUT
ROTATE CCW SWITCH
ON
ROTATE CCW OUTPUT
EXTEND SWITCH
ON
EXTEND OUTPUT
RETRACT SWITCH
ON
RETRACT OUTPUT
START/STOP BUTTON MOMENTARY
224
ON
STOP OUTPUT ON/ START OUTPUT ON IF PUSHED AGAIN WITHIN 5 SECOND
226
FAST IDLE BUTTON MOMENTARY
228
ON
FAST IDLE OUTPUT ON MAINTAINED/ OUTPUT OFF
230
E-STOP/ POWER BUTTON MOMENTARY
232
ON MOMENTARY
ON HELD
ALL OUTPUTS DISABLED-DISPLAY EC18
234
POWER ON/OFF
235
TRANSMITTER TRIGGER PROBLEM
236
DISPLAY EC16
238

DIAGNOSTIC READOUT FOR OPERATION OF A CRANE

BACKGROUND OF THE INVENTION

Cranes are typically used to lift and/or relocate loads from one location to another. Generally, cranes are used to lift or lower loads between a ground level or from a transport vehicle to a different elevation. In other applications, cranes are used to relocate loads from one location, such as a cargo carrier to a land vehicle. In all applications of the use of cranes, a load is generally lifted by a hook mechanism suspended by a cable at the end of a boom. The boom can be lifted vertically and rotated from side to side to move the load to a variety of horizontal and vertical locations.

The operation of a crane requires a high degree of skill so that the loads can be moved efficiently and safely. The safe operation of a crane is especially important when mounted to a mobile vehicle, such as a truck. In this situation, if the load is heavy and extended horizontally too far from the truck, the crane will overbalance the vehicle and cause it to tip over. This occurrence can not only lead to damage of the load, but also nearby structures, as well as the vehicle and the operator and persons in the vicinity of the crane operation.

The skill in the operation of a crane is apparent. The operator must be knowledgeable of the various loads that can be lifted as a function of the angle of the boom with respect to a horizontal reference, or the radius of the load. This is complicated with the operation of cranes that have the ability to shorten and lengthen the boom. As the boom is lengthened, for a given load radius, the load capacity is less. The operators of cranes are provided with readily available graphs and other information so that the safe operating parameters are not exceeded.

Cranes are conventionally equipped with various sensors and switches to control the safe operation of the crane. The switches are connected to hard wired control apparatus so that when an overload is sensed, the control apparatus disables further operation of the crane. For example, cranes equipped with load sensors provide disable signals when a load exceeding the rated limit is encountered. In these rudimentary control systems, there are no visual readouts of the exact nature of the problem, only the apparent problem that the crane will not operate. The skill of the operator is required to not only be aware of the activation of any of the control switches, but also to quickly diagnose all indications of imminent problems and remedy the same before a catastrophe occurs.

The diagnosis of problems with the normal operation of a crane has been automated to provide the operator with a visual readout of a code representative of the problem. Kar-Tech of Delafield, Wis. markets a Versa Remote full featured remote control system for a use with cranes. This system is processor-controlled and connected to various sense switches of the crane to provide a self diagnosis when various parameters of the crane have been exceeded. Once diagnosed, the controller provides a read-out code so that the operator can be made aware of the nature of the problem. A wireless transmitter is also marketed by Kar-Tech to provide coded signals to the controller to activate and deactivate the various components of the crane, such as boom rotation, extension, up/down movement of the boom, and a hoist for winding and unwinding the wire rope cable.

There remain yet other areas for controlling cranes and similar equipment to increase the safety of the operators and the equipment itself. For example, the operator is yet able to cause the crane components to be moved at speeds that may be unsafe, as a function of the load. This discretion is still vested with the operator. Accordingly, there are yet various areas where this control can be monitored and overridden if the conditions dictate that the operator is operating the crane near or outside the envelope of safe operation.

It can be seen from the foregoing that a need exists for a diagnostic system for automatically diagnosing an imminent problem concerning the speed of operation of the crane components, and providing the operator of an indication thereof. Another need exists for a control system which overrides the operator commands to move the crane at a rate that is unsafe to personnel or equipment, as a function of the load conditions. Yet another need exists for a system that includes a controller for controlling the various movements and actions of a crane in response to wireless commands, a number of sensors coupled to the controller, and a software program in the controller for responding to the sensor signals for diagnosing problems and generating an error code for presentation on the display. A further need exists for a technique for downloading new or revised diagnostic software programs into the controller.

SUMMARY OF THE INVENTION

In accordance with the principles and concepts of the invention, there is disclosed a control system for a crane that displays status codes of the operation of the crane apparatus. The operator of the crane can take appropriate action based on the status code, rather than have to assimilate the crane operation itself in order to make a mental diagnosis of the condition of the crane. In accordance with another feature of the invention, the control system monitors the hydraulic pressure of the crane lift mechanism, and prevents certain actions by the operator in order to maintain safe operational limits of the crane, and a safe environment for personnel in the vicinity of the crane.

Another feature of the invention is the use of various sense switches connected to the crane apparatus to monitor the position or condition thereof. The state of the switches is monitored by the control system. In addition, the control system receives commands input thereto by the operator of the crane. Based on the condition of the state of the switches, the control system can override the command requests by the operator in order to prevent damage to the crane, and prevent hazardous conditions to personnel. When overridden, the operator can determine from the status code displayed by the control system why the operation requested cannot be carried out.

An important aspect of the invention is the use of a pressure transducer coupled to a lift cylinder of the crane to monitor the extent of the load on the boom of the crane. The analog signal from the pressure transducer is processed by the control system. The operation of the crane is controlled, based on the pressure indication. The processor in the control system is programmed to define different pressure ranges, and corresponding actions to take, together with the input commands by the operator, to efficiently and safely operate the crane to produce the results desired by the operator.

A corollary aspect of the invention is to sense the hydraulic pressure of the lift cylinder and allow the crane movements to be carried out in an expedited manner. As the pressure increases, indicating an increased load on the crane, or an increased load radius, the rate of speed of the movements is slowed down to prevent the possibility of damage to the crane or unsafe operation thereof. When an overload condition is sensed, by the pressure exceeding a predefined amount, the various actions of the crane are automatically limited or stopped, and those not allowed but nevertheless requested by the operator are denied.

In accordance with yet another feature of the invention, the control system is constructed to operate with a wireless transmitter. The wireless transmitter has a number of switches and buttons for transmitting coded signals to the receiver portion of the control system. The operator can thus control the operations of the crane, visually observe the status codes provided by the control system, and make expedited and accurate decisions for moving the crane apparatus to safely achieve the desired results.

As to another aspect of the invention, a hand-held programmable device can be used to download programming parameters to the processor of the control system.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which:

FIG. 10 illustrates the transmitter inputs to the programmable controller, and the corresponding responses by the programmable controller.

DETAILED DESCRIPTION OF THE INVENTION

Figure 1:
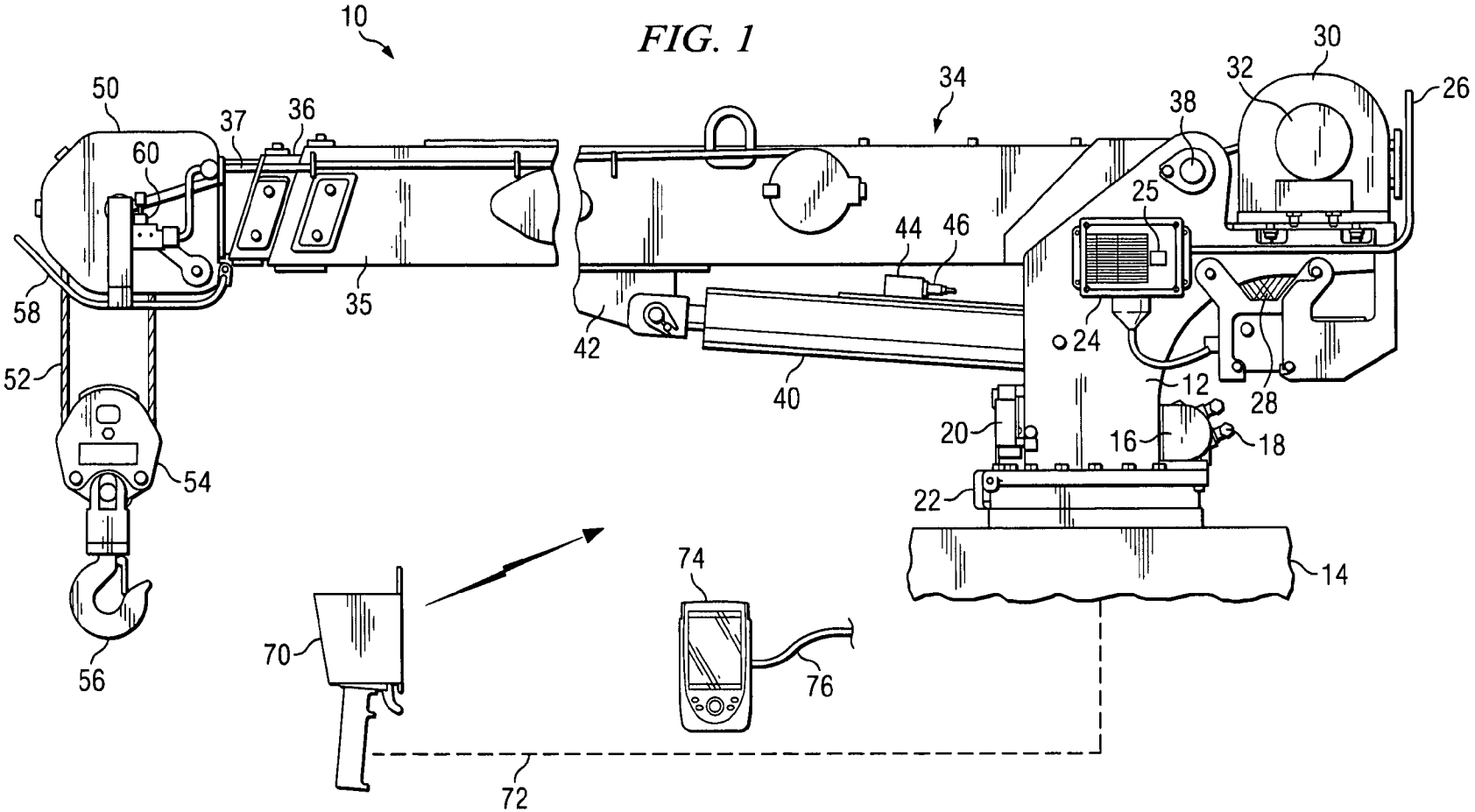
FIG. 1 is a side view of a conventional crane with an extendible boom, as mounted by a pedestal on a platform, and controlled by way of a wireless transmitter.

With reference to FIG. 1, there is shown a stiff arm type of crane 10 in which the invention can be advantageously practiced. The crane 10 includes a swivel pedestal assembly 12 mounted for rotational movement to a platform 14. The platform can be a truck bed, another type of vehicle, or a stationary platform. The invention is well adapted for use as a truck-mounted service crane. The pedestal assembly is rotatable by the use of gears of a conventional type and a hydraulic motor 16 to which high pressure hydraulic connections 18 are fixed. As will be described more fully below, the pedestal assembly 12 is rotatable through 370 degrees. This limited rotation allows hydraulic and electrical cables to be routed through the central cylindrical portion of the pedestal assembly 12.

Mounted to the pedestal assembly 12 is a magnetic home sensor switch 22 and corresponding switch mechanism 20 for sensing the rotational position of the pedestal assembly 12, namely a 0° position and a 370° position. An programmable controller 24 and associated antenna 26 are mounted to the side support of the pedestal assembly 12. The programmable controller 24 is equipped with a visual display 25 for displaying error codes to the operator. As will be described more fully below, the error codes reveal the status of the operation of the crane 10. By knowing the status of the crane 10, the operator can take the appropriate action without mentally considering all the positions of the crane apparatus to determine what problem might exist. A number of hydraulic valve controls 28 are mounted to the pedestal assembly 12, as is a hoist 30. The hoist 30 has a wire rope drum (not shown) that can be rotated in one direction or the other by a hydraulic motor 32. The wire rope is thus effective to lift and lower a load.

A telescopic boom 34 has three sections, including a lower boom 35, a middle boom 36 telescopic inside the lower boom 35, and an upper boom 37 telescopic inside the middle boom 36. The lower boom 35 is anchored to the pedestal assembly 12 by a large pivot pin 38. A hydraulic lift cylinder 40 is pinned to the pedestal assembly 12 at the lower end thereof. The rod of the lift cylinder 40 is pinned to a bracket 42 welded to the underside of the lower boom 35. The lift cylinder 40 is of the double-acting type with a hydraulic connection 44 and a hydraulic pressure transducer 46 for monitoring the hydraulic pressure experienced by the lift cylinder 40. The pressure transducer 46 is of conventional design for providing an analog output voltage as a function of the pressure input.

The middle boom 36 and the upper boom 37 are extendible and retractable by respective double acting hydraulic cylinders (not shown). When extended, the boom 34 is lengthened, and when retracted the boom 34 is shortened. Mounted to the end of the upper boom 37 is a crown assembly 50. The crown assembly 50 has mounted therein for rotation a sheave (not shown) for routing the wire rope 52 therearound. In one of many different configurations well known, one end of the wire rope 52 can be fastened to the crown assembly 50 while the other end is wound on the drum of the hoist 30. The wire rope 52 is shown routed around a pulley housed within a conventional traveling block 54. The traveling block 54 has mounted thereto a hook 56 for attachment to loads.

In order to monitor when the traveling block 54 is moved by the wire rope 52 into contact with the crown assembly 50, there is provided a pivotal bail 58. Attached to the bail 58 is a bracket that moves into engagement with a microswitch 60. A closure of the contacts of the microswitch 60 is an indication to the programmable controller 24 that the traveling block 54 has come into contact with the crown assembly 50, and that the hoist motor 32 should be halted.

The programmable controller 24 operates in conjunction with a wireless hand-held FM transmitter 70. The wireless transmitter transmits coded FM signals to the programmable controller 24. The programmable controller 24 receives the coded FM signals via the antenna 26, decodes the signals and controls the various functions of the crane 10. In this manner, the crane 10 can be remotely controlled by an operator using the hand-held transmitter 70. As will be described below, the wireless transmitter 70 has a number of switches for starting or stopping the various movements of the crane 10. The wireless transmitter 70 can be connected by an electrical pendant cord to the programmable controller 24, as shown by the dotted line 72. The pendant cord 72 is connected to the programmable controller 24 through the underside of the crane pedestal assembly 12. When connected, the rechargeable battery of the wireless transmitter 70 can be recharged. Additionally, the transmitter can communicate the coded signals directly to the programmable controller 24 via a Controller Area Network (CAN). This is advantageous when communications by FM signals is in an environment that is unreliable. The programmable controller 24 and the FM wireless transmitter 70 are conventionally available from Kar-Tech, Inc., Delafield, Wis. as respective models 3B0123 and 3B0122. The operating frequency between the wireless transmitter 70 and the receiver 24 is 900 MHz, and the signals are coded on the carrier frequency by way of pulse width modulation (PWM).

A hand-held personal digital assistant 74, such as a Palm® digital assistant 74, can be connected by a cable 76, to the programmable controller 24 for programming thereof. The end of the cable 76 is connectorized for connection to a corresponding connector mounted inside the cover of the programmable controller 24. The personal digital assistant 74 can be used to upload software programs to the programmable controller 24 in the field, or to change the programming parameters.

Figure 2A:
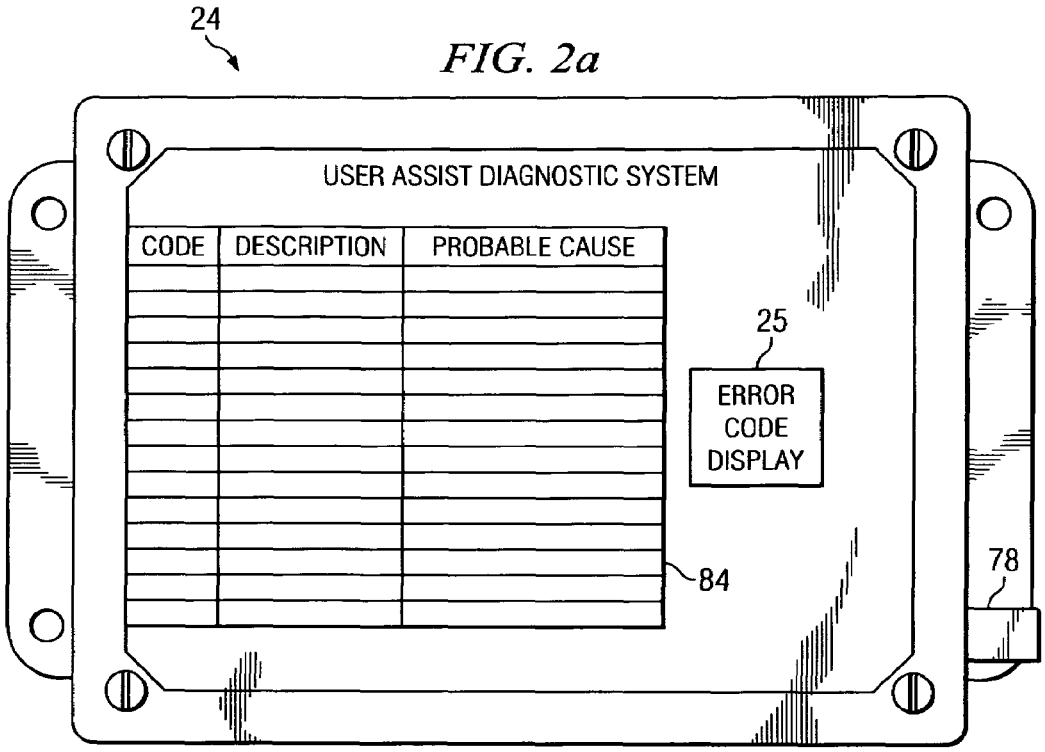
FIG. 2*a* and FIG. 2*b* are respective front and bottom views of a programmable controller for controlling the operations of the crane.
Figure 2B:
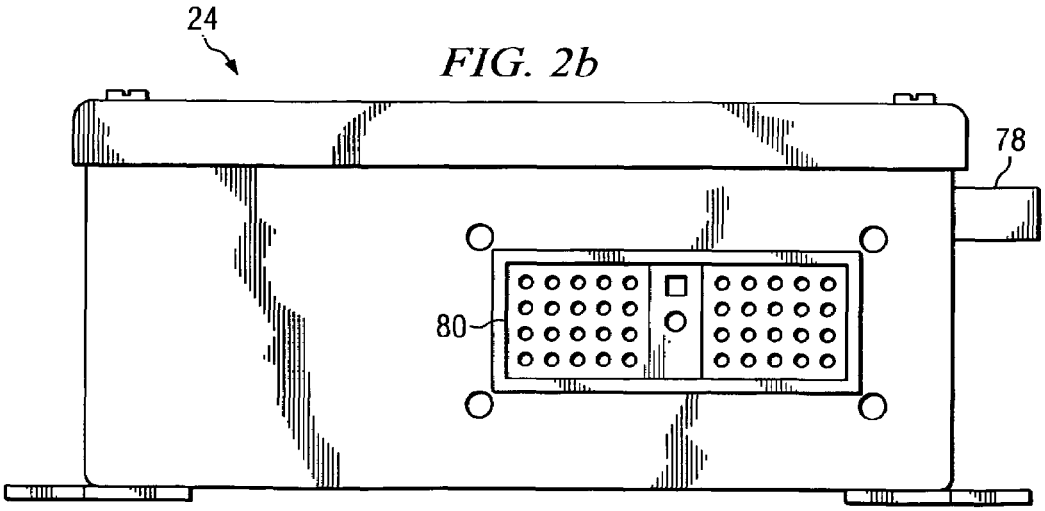

FIGS. 2*a* and 2*b* are drawings of the programmable controller 24. The programmable controller 24 has an antenna connector 78 for connection via a coaxial cable to the FM antenna 26. Located at the bottom of the programmable controller 24 is a 40-pin connector 80 that provides the power, as well as the input and output signals with respect to the crane control systems. In accordance with an important feature of the invention, the programmable controller 24 is equipped with a 4-digit readout 25 that provides the operator of the crane with a visual indication of the status of the crane 10. The readout presented on the display 25 is in coded form. A menu 84 of the codes are listed on the front panel of the programmable controller 24 so that an operator can easily cross reference the codes to the particular status of the crane lO. When the operator is made aware of a certain status, such as "overload", the operator can take the necessary measures to alleviate the overload condition.

Figure 3A:
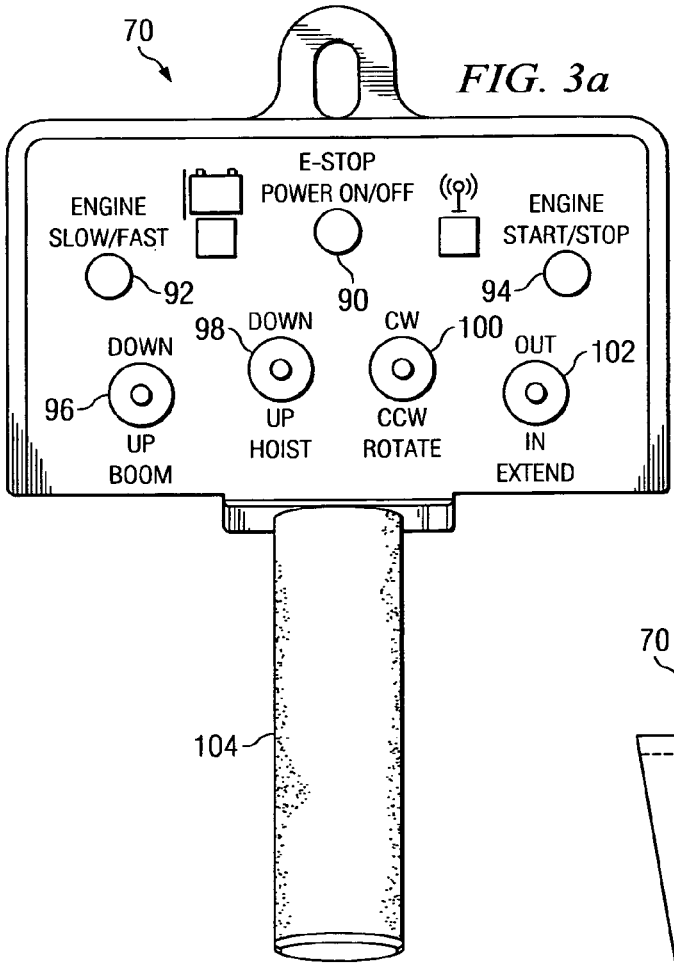
FIG. 3*a* and FIG. 3*b* are respective front and side views of a conventional hand-held wireless transmitter for transmitting commands to a controller mounted to the crane for remotely controlling the operations of the crane.
Figure 3B:
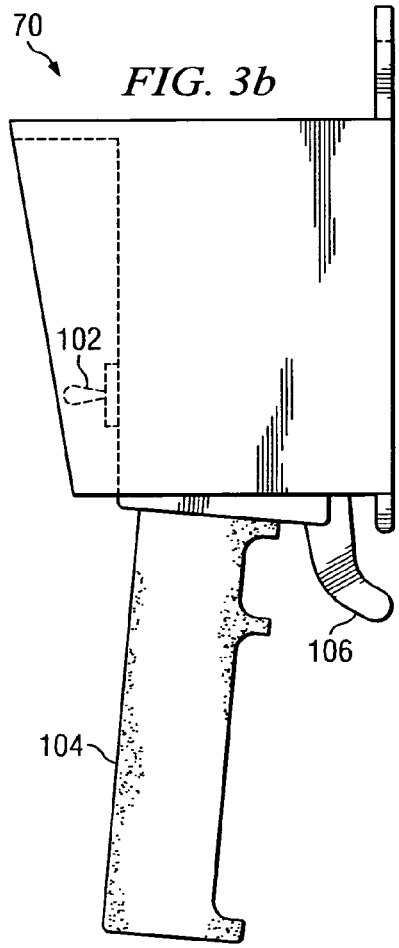

FIGS. 3*a* and 3*b* are views of the wireless FM transmitter 70 that provides communications to the programmable controller 24. The wireless hand-held transmitter 70 has an internal antenna. Also included are a number of switches that can be actuated by the operator to control the crane operation. The transmitter 70 includes an on/off push button switch 90. When pushed and held actuated for a period of time, the transmitter 70 is either powered on or off, depending on the previous state. The transmitter 70 includes a second push button switch 92 for controlling the engine speed of the vehicle to which the crane 10 is mounted. A third push button 94 is effective to control the start or stop status of the truck engine. The transmitter 70 includes four toggle switches 96–102 for controlling the crane movements. Switch 96 is a three-position (center off) switch for controlling the up and down positions of the boom 34. Switch 98 is a three-position switch for controlling the wire rope hoist 30 to move the load between up and down positions. The transmitter 70 includes a three-position switch 100 for controlling the clockwise or counterclockwise rotational position of the pedestal assembly 12, and thus the boom 34. Lastly, there is provided a three-position switch 102 for controlling the telescopic length of the boom 34 to effectively extend or retract the crown 50, and thus the load. Any combinations of the switches 96–102 can be operated at the same time to accomplish simultaneous movements of the various components of the crane 10.

The wireless transmitter 70 includes a hand grip 104 for grasping the device. Incorporated in the case of the transmitter 70 is a trigger 106. While the operator grasps the hand grip 104 of the transmitter 70, the forefinger of the operator's hand can be used to pull the trigger 106 and control the speed of operation of the crane components. The amount by which the trigger 106 is pulled determines the speed or rate of movement of the crane apparatus. For example, if the boom up/down switch 96 is pushed to the up position and the trigger 106 is pulled to an intermediate position, the crane boom 34 will move upwardly at a speed that is a function of the amount by which the trigger is pulled. The crane boom 34 can be moved upwardly at the fastest rate by pulling the trigger 106 the full amount. Essentially, the transmitter trigger 106 controls a proportional hydraulic valve, as will be discussed more fully below.

Figure 4:
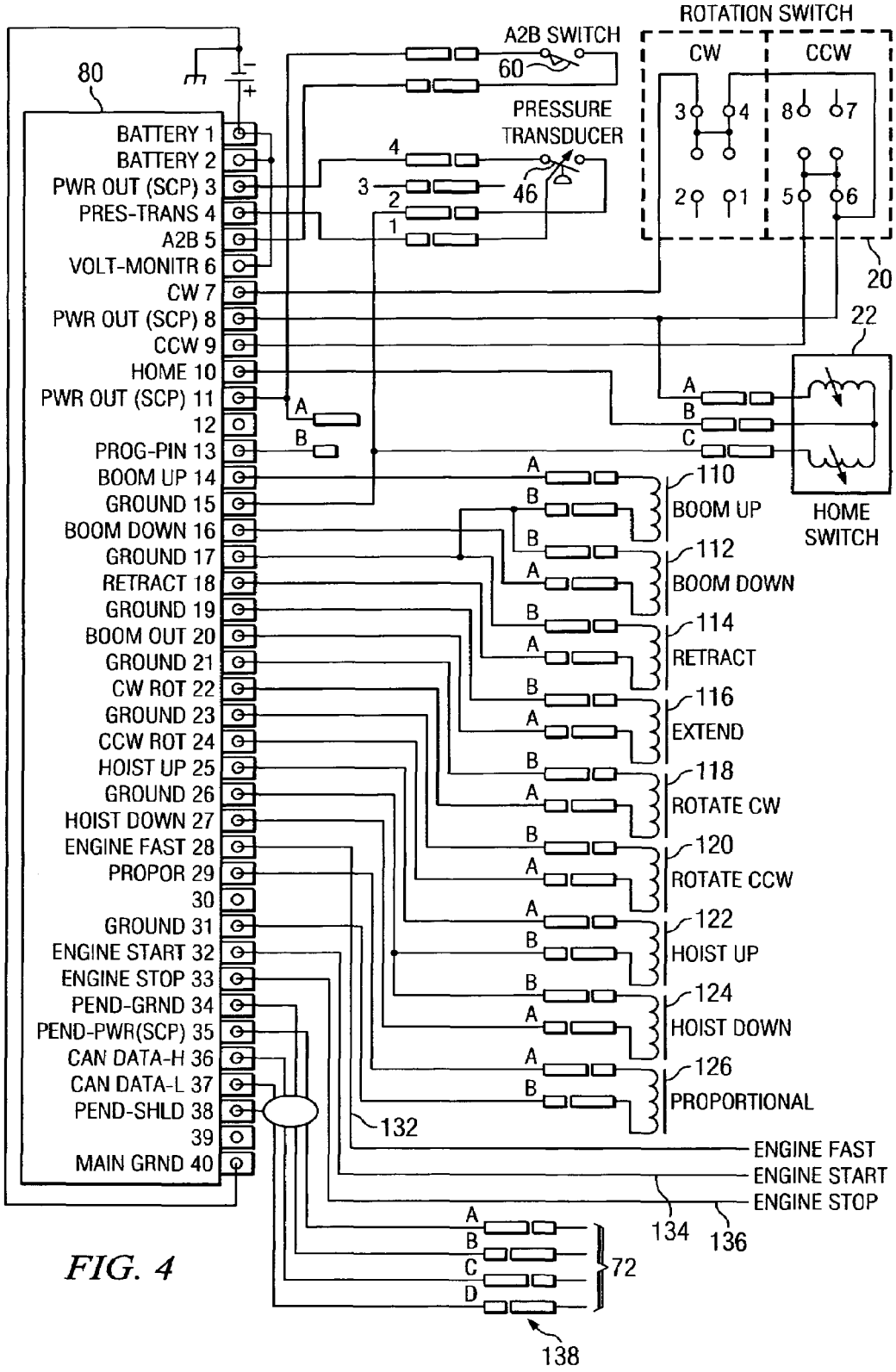
FIG. 4 is an electrical schematic drawing showing the connections between the programmable controller connector and the sensing switches for operating the crane apparatus.

FIG. 4 illustrates the connections between the connector 80 of the programmable controller 24 and the electrical control apparatus of the crane 10. The text located in the connector block 80 identifies the inputs and outputs of the programmable controller 24 in responding to the coded signals transmitted by the wireless transmitter 70. First, the vehicle battery power, such as 12 volts is applied to the circuits of the programmable controller 24 by connector pins 1 and 40. The open or closed status of the anti-2 block (A2B) switch 60 located on the boom crown 50 is coupled to the programmable controller 24 via pins 5 and 11, the latter of which is a source of DC power. The cylinder lift pressure transducer 46 provides an analog voltage between 0–5 volts to indicate the hydraulic pressure experienced by the lift cylinder 40. The analog voltage of the pressure transducer 46 is coupled to the programmable controller 24 via connector pin 4. The rotation limit switch 20 senses when the boom 34 of the crane 10 has been rotated a maximum amount between a reference zero degree position and a 370 degree position, and provides corresponding indications to the programmable controller 24 on connector pins 7 and 9. The home switch 20 senses when the boom 34 of the crane 10 is positioned in the home position, namely when the boom 34 is located over the cab of the vehicle and is ready to be lowered into a cradle for purposes of transport. The home position indication is coupled to the Programmable controller 24 via connector pin 10. The foregoing indications provide the programmable controller 24 with inputs for processing according to an algorithm to maintain safe and reliable operation of the crane 10.

Figure 5:
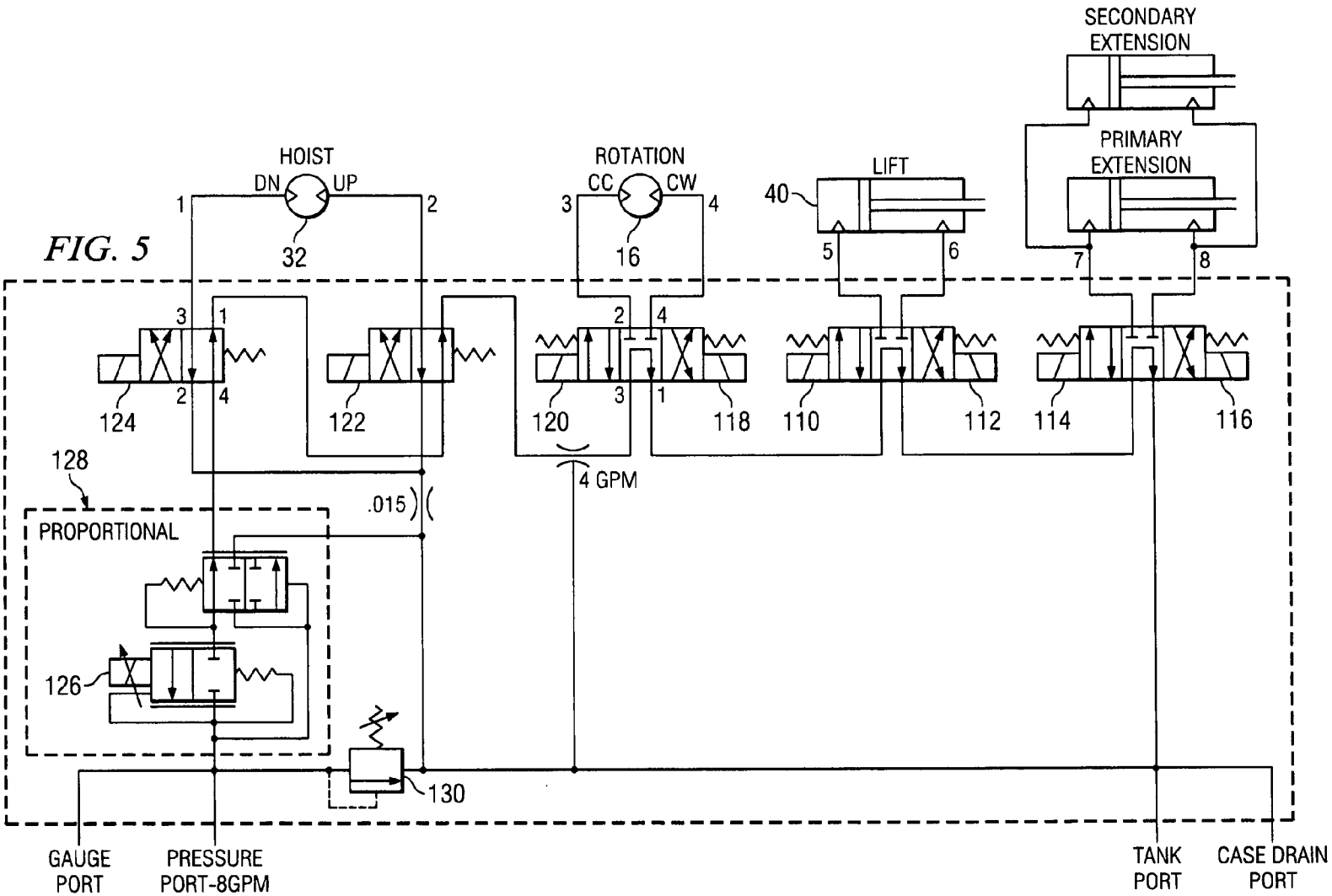
FIG. 5 is a hydraulic schematic drawing that illustrates the connections between the hydraulic valves of the crane apparatus.

The various outputs of the programmable controller 24 are used to operate solenoid-controlled hydraulic valves. The hydraulic schematic and hydraulic valves are shown in FIG. 5. When the programmable controller 24 decodes a "boom up" signal form the transmitter 70, the solenoid 110 is energized to thereby allow hydraulic fluid to cause the plunger of the lift cylinder 40 to be extended and lift the boom 34 of the crane 10. When a "boom down" signal is decoded by the programmable controller 24, the boom down solenoid 112 is energized to allow the boom 34 to be lowered. When the respective "retract" and "extend" signals are decoded by the programmable controller 24, the solenoids 114 and 116 are energized. Similarly, when the "rotate CW" and "rotate CCW" signals are decoded, the respective valve solenoids 118 and 120 are energized to rotate the crane hydraulic motor 16 in either a clockwise or counterclockwise direction. In response to the decoding by the programmable controller 24 of the "hoist up" and "hoist down" signals, the respective valve solenoids 122 and 124 are energized to cause the hydraulic motor 32 to rotate the wire rope drum in a direction to wind up the wire rope 52 or unwind the wire rope 52 therefrom. Lastly, the programmable controller 24 decodes the relative position of the hand trigger 106 of the transmitter 70 and provides an analog signal coupled to the solenoid 126 of the proportional valve 128. The proportional hydraulic valve 128 of FIG. 5 controls the volume of pressurized fluid that is coupled to the other hydraulic valves. It can be appreciated that the volume of hydraulic fluid that is coupled to the other control valves functions to control the rate of movement of the associated crane component. Accordingly, as the trigger 106 of the wireless transmitter 70 is pulled further, the proportional valve 128 is controlled to allow a greater volume of pressurized fluid to be coupled to the respective control valves. A relief valve 130 adjusted to a pressure of about 2750 psi functions to redirect the hydraulic fluid from the pressure port to the tank or fluid reservoir port.

With reference again to FIG. 4, when the programmable controller 24 decodes an "engine fast" signal transmitted from the wireless transmitter 70, a corresponding voltage level will be driven on conductor 132. If wired to do so, the voltage on conductor 132 can be zero volts indicating an idle speed, or nominally 12 volts which corresponds to the full desired speed of the vehicle engine. When the programmable controller 24 decodes an "engine start" signal, or an "engine stop" signal transmitted from the wireless transmitter 70, the programmable controller 24 drives the conductors 134 and 136 with respective signals of either zero volts or nominally 12 volts. In like manner, the 12-volt level driven on the "engine start" conductor 134 will cause the vehicle engine to start. In like manner, a 12-volt level driven on the "engine stop" conductor 136 will cause the vehicle engine to stop.

As noted above, the wireless transmitter 70 can be coupled by a CAN bus cable 72 to the programmable controller 24. The connector 138 for the CAN bus cable 72 is located in the cylindrical inner portion of the crane pedestal assembly 12. An operator can reach up in the pedestal assembly 12 from beneath and connect the connector ends between the wireless transmitter 70 and the connector 138 of the programmable controller 24.

Figure 6:
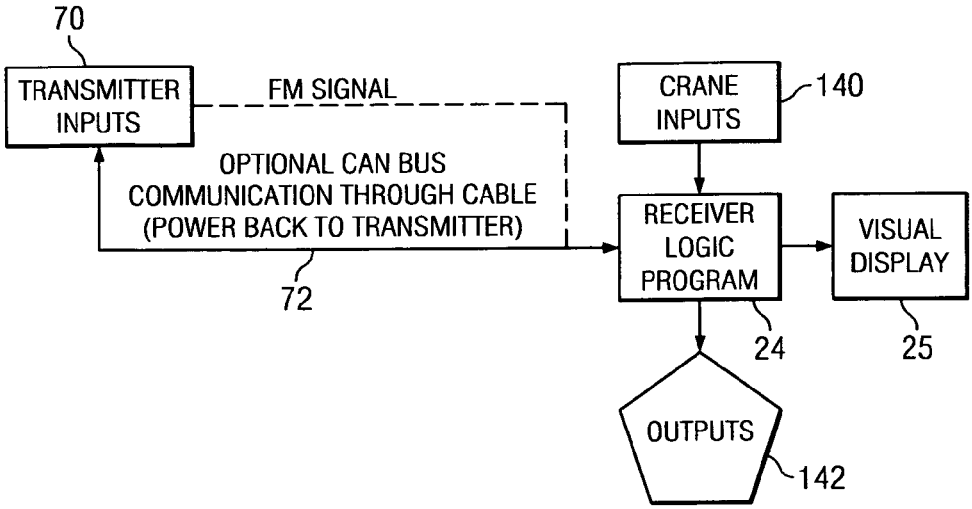
FIG. 6 is a block diagram of the wireless control system for a crane.

FIG. 6 is a simplified block diagram of the remotely controlled crane operating system, as described above. The wireless transmitter 70 encodes the actuation of the push buttons or toggle switches located on the transmitter 70 and transmits the same via PWM techniques to the programmable controller 24 mounted on the crane 10. There is provided the optional CAN cable bus 72 which provides battery charging current to the rechargeable battery of the wireless transmitter. In addition, the CAN bus 72 allows transmission of the encoded signals to the programmable controller 24 should wireless transmission be unreliable. The programmable controller 24 receives various inputs 140, such as the A2B switch 60, the rotation limit switches 20, the pressure transducer 46 and the home switch 22. The various outputs 142 of the programmable controller 24 include the voltages for driving the solenoids of the hydraulic valves. After processing the input indications of the various crane components, the overall status of the crane 10 is presented on the display 25 as an error code. Based on the error code displayed, the operator can quickly take the appropriate remedial action without having to assess the positions of the crane components and make a judgment as to the status of the crane 10.

The error codes and the corresponding status of the crane 10 are set forth below. The text is displayed on the frontal face 84 of the programmable controller 24 for easy reference by the crane operator.

EC01—No data being received from transmitter.

EC02—Short or open connection at BOOM UP output.

EC03—Short or open connection at BOOM DOWN output.

EC04—Short or open connection at BOOM IN output.

EC05—Short or open connection at BOOM OUT output.

EC06—Short or open connection at ROTATE CW output.

EC07—Short or open connection at ROTATE CCW output.

EC08—Short or open connection at HOIST UP output.

ECO9—Short or open connection at HOIST DOWN output.

EC10—Signal from transmitter has incorrect ID code.

EC15—Pressure sensor problem.

EC16—Transmitter trigger problem.

EC17—Trigger of transmitter was activated before function switch was activated.

EC18—E-Stop was activated.

EC19—Rotation proximity switch error.

LBV—Low Battery in vehicle.

OLV1—Pressure Overload during BOOM EXTEND or HOIST UP.

OLV2—Pressure Overload during BOOM UP or BOOM DOWN.

A2B—Anti-Two Block switch actuated.

RSBM—Boom hydraulic pressure less than 80 psi, raise boom.

HOME—Boom in home position, ready to be stowed.

RS1—Boom over Rotation Switch 1

RS2—Boom over Rotation Switch 2

NRML—Normal operation

Figure 7:
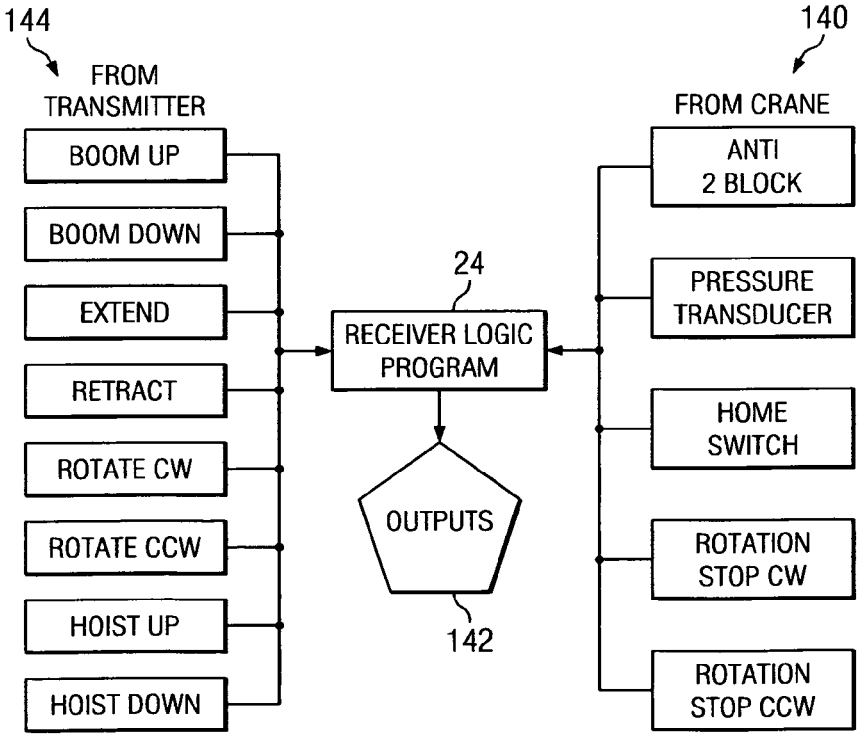
FIG. 7 is a block diagram of the programmable controller provided with the various wireless transmitter inputs, and the inputs from the moving components of the crane.

FIG. 7 illustrates in more detail the various inputs 144 to the programmable controller 24 from the transmitter 70, and the various inputs 140 to the programmable controller 24 from the crane sense switches. The programmable controller 24 is programmed to process these inputs and provide appropriate outputs to insure safe operation of the crane 10. For example, if the boom 34 of the crane 10 is positioned fully clockwise, as sensed by the rotation limit switch 20, and if the operator actuates the "Rotate CW" switch 100 on the wireless transmitter 70, the processor in the programmable controller 24 will not attempt to cause further clockwise rotation of the boom 34 of the crane 10. As another example, if the pressure transducer 46 of the lift cylinder provides an input to the programmable controller 24 that there is little or no hydraulic pressure applied to the lift cylinder 40, the processor of the programmable controller 24 will not respond to any commands transmitted by the operator to cause the hoist to raise a load. This is to ensure that the boom 34 of the crane will not be overloaded by resting the boom on an object and lifting an oversized load. This crane operation is prohibited because of the chance of buckling the boom 34. In other words, when the boom 34 of the crane 10 is rested on an object, the lift cylinder pressure is not an indication of the extent of the load, and the control system of the crane is unable to guard against damage to the crane apparatus when lifting loads heavier than authorized.

Figure 8:
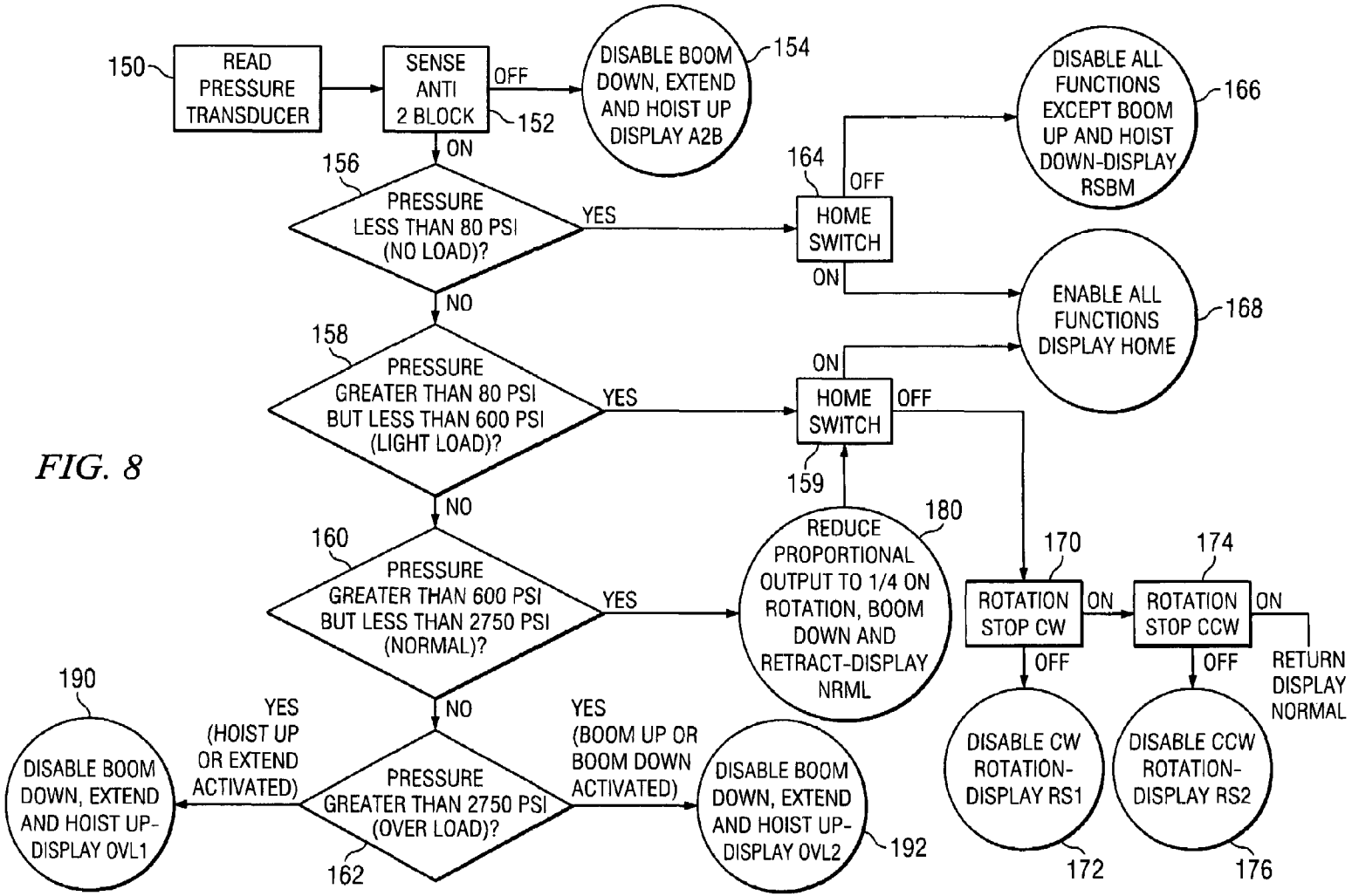
FIG. 8 is a software logic flow chart showing the functions in controlling the rate of movement of the crane components, and the overriding control thereof by the programmed controller.

In accordance with an important feature of the invention, the processor in the programmable controller 24 is programmed to provide the various error codes when the operation of the crane is normal, as well as when the crane operation is other than that desired by the operator. With the error codes presented on the visual display 25, the operator has readily available the diagnosed problems of the crane apparatus. FIG. 8 is a flow chart depicting the functions carried out by the programmed processor in the programmable controller 24 in providing the various error codes, as a function of the inputs provided to the programmable controller 24 via the transmitter 70 and the crane sense switches 140. As will be noted below, the programmed controller 24 can cause the crane to operate, or prevent operations contrary to the commands transmitted by the operator from the wireless transmitter 70.

In processing the crane sense switch inputs according to FIG. 8, the processor of the programmable controller 24 first reads the output of the pressure transducer 46, which yields an indication of the load suspended from the wire rope 52. Various actions are carried out based on the hydraulic fluid pressure sensed by the pressure transducer 46. The pressure sensing step is shown by block 150. The processor next determines the status of the anti-2 block switch 60 attached to the crown assembly 50 of the boom 34. This is shown in block 152 of the program flow diagram. If the processor determines that the contacts of the anti-2 block switch 60 open (or "off"), meaning that the traveling block 54 has been raised to the point where it engages the bail 58, then any downward movement or extension of the boom 34 requested by the operator is prevented. In addition, any further attempt by the operator to raise the hoist 30 and corresponding load is prevented. The error code "A2B" is displayed so that the operator knows the nature of the problem without further mental analysis. This overriding control of the crane 10 by the programmed controller 24, and display of the corresponding error code, is shown in program flow block 154. Prior to the provision of the "A2B" display to the operator, the anti-2 block switch 60 was hardwired to prevent further upward movement of the traveling block 54, but the crane operator had to diagnose the cause of the failure of the traveling block 54 to move in the upward direction.

In response to the visual display of the error code "A2B," the crane operator can press the "hoist down" toggle switch 98 of the wireless transmitter 70 so that the wire rope 52 is let out and the traveling block 54 is moved away from its engagement with the bail 58. The crane operator can then proceed to operate the crane in a normal manner.

In the event that the anti-2 block switch 60 is sensed in program flow block 152 and found to be in the normal position, e.g. closed or "on", program flow proceeds to block 156 where the processor reads the analog voltage produced by the pressure transducer 46. In accordance with an important feature of the invention, the processor of the programmable controller 24 exerts different controls over the operation of the crane 10 as a function of the output produced by the pressure transducer 46. The processing branches in different directions based on whether the pressure reading output by the pressure transducer 46 is greater or less than about 80 psi, as shown in block 156. Different control of the crane 10 is exerted if the pressure output by the pressure transducer 46 is greater than 80 psi and less than 600 psi (decision block 158), or greater than 600 psi and less than 2750, as shown in decision block 160. If the pressure is greater than about 2750 psi, as determined by program flow decision block 162, then yet other control of the crane 10 is maintained. This control of the crane 10 as a function of the hydraulic pressure on the lift cylinder 40, as measured by the transducer 46, provides a higher degree of operability, while yet maintaining a high degree of safety for personnel and equipment.

With reference back to decision block 156 of FIG. 8, if the pressure output by the transducer 46 is less than 80 psi, program flow branches to decision block 164. A reading of less than 80 psi indicates that there is either a very light load on the wire rope 52, or no load at all. The state of the home switch 22 is sensed by the processor of the programmable controller 24 in block 164 to determine if the boom 34 has been swivelled to a position considered "home", such as over the cradle for stowing. If the processor senses from the home switch 20 that the boom 34 is not in the home position (and the pressure transducer output is less than 80 psi), processing branches to block 166. Here, all operations of the crane 10 are disabled, except for the boom up and the hoist down operation, if the operator so desires to perform these two operations. In other words, with no load on the crane 10, the operator can either raise the boom 34 and/or lower the traveling block 54. In this state, the processor causes the error code "RSBM" to be displayed, meaning that the operator can raise the boom 34 to ensure that it is not resting on another structure, or that the lift cylinder 40 is not bottomed out.

If the pressure reading of the transducer 46 is less than 80 psi and the home switch 20 is on, processing branches to block 168. The instructions carried out according to this program flow block 168 allow the operator to safely stow the boom 34 of the crane 10 in the cradle. In this state, all crane operations are enabled, except if the crane is in an overload condition. The error code "HOME" is displayed on the visual display 25.

In the next step, the processor proceeds with the actions involved when the pressure read from the transducer 46 is between 80 psi and 600 psi, as noted in decision block 158. This range of hydraulic pressures is considered as associated with a light load. With this status of crane operation, the boom 34 and other crane apparatus can be moved at a higher rate of speed, as compared to a crane status involving a heavy load. Accordingly, after sensing the status of a normal or heavy load, the processing branches to block 159 where is it determined whether the home switch 22 has been activated. If the state of the home switch 22 is off, the processor further determines the state of the rotation switch 20, as shown in block 170 (maximum CW rotation) and block 174 (maximum CCW rotation). This determination is made by sensing the state of the rotation switches 20 located on the pedestal assembly 12 of the crane 10. If the CW limit switch is opened, denoting a maximum rotation of the boom 34 in the clockwise direction, the processor disables (block 172) further clockwise rotation of the pedestal assembly 12 and thus further clockwise rotation of the boom 34. The error code "RS1" is displayed so that the operator can commence counterclockwise rotation of the boom 34. Similarly. If the processor senses that the CCW limit switch 20 is open, denoting maximum counterclockwise rotation of the crane boom 34 (block 174), further CCW rotation of the boom 34 is prevented. The error code "RS2" is displayed (block 176) for viewing by the operator for remedial action.

In the event that the home switch 22 is determined to be in the on state in block 159, processing branches to block 168 where the same operations are carried out as described above. In the processing of the instructions in carrying out the algorithm of FIG. 8, after there is a display of an error code, the processor branches back to block 150 where the hydraulic pressure of the transducer 46 is again read to determine what action should be taken next. It is also important to understand that once the status of the crane 10 and corresponding error code is determined, such status remains identified in the processor until that status has changed. Multiple error codes may thus be active simultaneously, even though only one error code is displayed. To that end, the error codes are prioritized and the most important error code is displayed. If the presently displayed error code has been found to be resolved and the associated status no longer exists, then the next highest priority active error code is displayed. Those skilled in the art may find that it would be advantageous to provide two or more displays to display multiple, or all, active error codes in the ranking of highest priority to the lowest priority. In this manner, the crane operator can simultaneously see all the error codes at the same time. Alternatively, there may be provided a manual push button switch on the programmable controller 24 to allow the operator to step through all the active error codes. By an "active" error code, it is meant that some event has occurred and the program senses the same and the corresponding error code is caused to be active and displayed.

With reference back to program flow block 158, processing branches to decision block 160 if the hydraulic pressure read from the transducer 46 is found to be greater than 600 psi. If in decision block 160 it is determined by the readout from the pressure transducer 46 that the lift cylinder pressure is between about 600 psi and 2750 psi, processing branches to program flow block 180. This range of hydraulic fluid pressure is considered to be in a normal operating range for lifting loads by the crane 10. It is to be understood that these pressures are examples of the operation of a particular crane, and other cranes using other hydraulic equipment may require different operating pressures and parameters.

In block 180 the fluid flow to the various hydraulic valves is reduced to one fourth the normal flow. The reduction in the hydraulic fluid flow affects the operations of rotation of the boom 34, downward movement of the boom 34 and retraction of the boom 34. In essence, when the crane 10 is operating under normal load conditions, these apparatus movements are slowed down to minimize potential stresses and overload conditions. Stated another way, those crane movements which may have the effect of increasing the moment of the load, are slowed down so as to minimize the possibility of exceeding the rated load limits of the crane 10. In addition, since this represents a normal operating condition of the crane 10, the processor displays the code "ML" on the display 25.

From block 180, processing proceeds to block 159 where the state of the home switch 22 is again tested. In the event the home switch 22 is found to be in the on state, the processor proceeds to block 168 where the same operations are carried out as described above. If the home switch 22 is found to be in the off state, processing proceeds to block 170. The sensing of the maximum clockwise rotation of the boom 34 (block 170) and the sensing of the maximum counterclockwise rotation of the boom 34 (block 174) is carried out by the processor, and if the sensing operation is in the affirmative, then the respective direction of rotation is prevented, as noted in blocks 172 and 176. Additionally, when the limits of rotation have been encountered and sensed, the processor displays the appropriate error code "RS1" or "RS2", for indicating "boom over-rotation CCW" and "boom over-rotation CCW." The remedial action that can be taken by the operator is to rotate the boom 34 of the crane in a direction opposite that indicated on the readout of the display 25.

From block 160, if the hydraulic pressure of the lift cylinder 40 is found to exceed 2750 psi, as determined by decision block 162, the processor carries out functions related to overload conditions. As noted above, when the hydraulic pressure sensed by the transducer 46 exceeds 2750 psi, this represents an overload condition, due either to a load exceeding that specified as a function of the load radius, or bounce and unstable movement of the load. As can be appreciated, an overload condition on the crane 10 can be produced under many circumstances. For example, if the load suspended from the wire rope 52 at a particular spatial location is just under the acceptable moment allowed, and if the boom 34 is then extended, the acceptable maximum moment will be exceeded and the crane 10 will become overloaded. Under these same conditions, if the boom 34 is lowered, the moment will also increase.

In sensing an overload condition, as noted by program flow block 162, certain actions requested by the operator are denied, depending on what is requested via commands from the wireless transmitter 70. For example, if the operator requested a "hoist up" action or a "boom extend" operation, the processor decodes the same and denies both requests, as shown in block 190. In addition, the processor disables any "boom down" action. When this sequence occurs in response to the "hoist up" or "boom extend" commands, the processor displays the error code "OVL1", indicating the actions requested and denied.

If the processor decoded "boom up" or "boom down" commands during an overload condition, then the actions shown in block 192 are taken, which are the same as those taken in block 190, except that the error code "OVL2" is displayed. This error code indicates the "boom up" and "boom down" commands cannot be undertaken during the overload status of the crane 10. Those skilled in the art can realize that if the crane 10 is in an overload condition, the raising or lowering of the boom 34 could cause bounce which would only aggravate the overload condition. Once the overload condition is removed by further actions of the crane operator, the overload status will be removed by the processor in the programmable controller 24. Processing will continue based on the hydraulic pressure of the pressure transducer 46.

According to the prior art use of the of an overload switch, there was provided a pressure switch that would sense a hydraulic pressure exceeding 2750 psi. Once the pressure in the lift cylinder exceeded this amount, the hard wire signal would prevent operation of the crane 10. Again, the operator would have to investigate why the crane was not operational and proceed in correcting the situation that led to the overload. In accordance with the invention, the nature of the problem is diagnosed by the software program and displayed for use by the crane operator. The use of a pressure transducer 46 not only allows different functions to be carried out as a function of the load, but the various pressure parameters can be reprogrammed in the programmed controller 24 without having to replace a fixed pressure sensor with another. If it is determined that for a particular crane the maximum load corresponds to 2000 psi, rather than 2750 psi, then the same pressure transducer 46 can be used, but the software program is changed to insert at the appropriate instructions in blocks l60 and 162 the 2000 psi parameter instead of the 2750 psi parameter. The personal digital attendant 74 (FIG. 1) can be used to reprogram the programmed controller 24 to update parameters in the event that it is found that better parameters should be used, or new parameters are being uploaded to a newly installed programmed controller 24.

Figure 9:
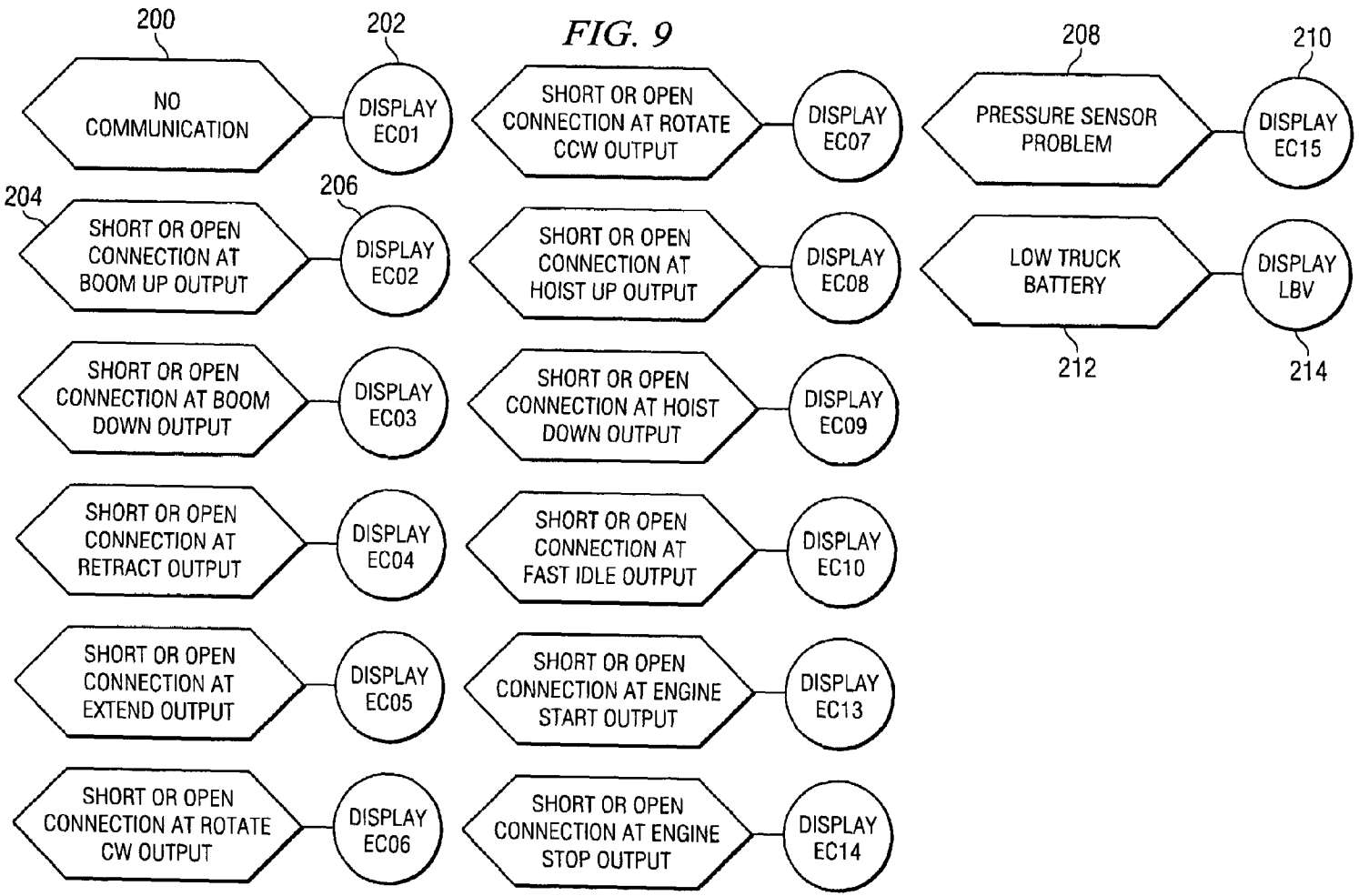
FIG. 9 illustrates the various status situations of the crane, and the corresponding error codes displayed by the programmable controller.

FIG. 9 is a diagram showing the numerous inputs provided to the programmable controller 24 and used to control the functions of the crane 10. For example, when the programmable controller 24 receives no coded signals from the wireless transmitter 70, the error code EC01 is displayed. This is a state of the system when the operator has not activated any switch or button of the transmitter 70. The processor of the programmable controller 24 also senses when one or more of the connections to a valve solenoid is open or short circuited. This is shown in block 204. For example, if the winding of the boom up solenoid 110 is open circuited, if the corresponding connector socket is open, or if the wires are short circuited, the processor can detect the same. When any of these conditions are sensed, the processor displays the error code EC02, as shown by reference numeral 206. The open or short circuit conditions of the remaining solenoid coils can be sensed in a similar manner, as shown in FIG. 9.

In block 208, the processor processes a routine for determining if the pressure transducer 46 is operating properly. If a problem is detected, the error code EC15 is displayed. The display of the error code is shown in block 210. The magnitude of the vehicle battery voltage is monitored by an analog-to-digital converter in the programmable controller 24. If the vehicle battery voltage is out of limits, as noted in block 212, the error code LBV is displayed (block 214).

FIG. 10 illustrates the various inputs from the wireless transmitter 70 to the receiver 24, and the corresponding functions performed by the processor in controlling the crane apparatus. For example, when the boom switch 96 of the transmitter 70 is toggled to the down position, the corresponding coded signal is received by the programmable controller 24, decoded, and a signal is generated to activate the solenoid winding 110. As long as the toggle switch 96 is held down by the operator, the solenoid coil 110 remains energized. These actions and responses are shown by blocks 220 and 224. In addition, when the trigger 106 of the transmitter 70 is pulled a certain amount, the corresponding coded signal is decoded at the programmable controller 24 and caused to energize the proportional valve solenoid 126. As noted above, the extent to which the transmitter trigger 106 is pulled, determines the extent of opening of the proportional valve 128 and thus the amount of hydraulic fluid that is supplied to the activated hydraulic device. In this manner, the speed of the crane component connected to the activated hydraulic valve is controlled. The other transmitter outputs are shown as inputs to the programmable controller 24 in FIG. 10, as are the corresponding responses by the programmable controller 24.

The start/stop push button 94 on the transmitter 70 provides an input to the programmable controller 24 (block 224). When the start/stop push button 94 is depressed once, an output of the programmable controller 24 on conductor 136 is generated to stop the vehicle engine (block 226). When the start/stop push button 94 is pushed twice in close succession, an engine start signal is output on conductor 134 to the vehicle engine start and stop control system. The transmitter fast idle push button 92 provides an input (block 228) to the programmable controller 24. When received and decoded, the programmable controller 24 provides a signal on output conductor 132 (block 230). The transmitter 70 is equipped with an emergency stop push button 90. If pushed once by the operator, the receiver 24 prevents decoding of all subsequent signals generated by actuation of the other push button or toggle switches of the transmitter 70 (block 232). This effective stops or interrupts further change in the operation of the crane 10. The processor generates the error code EC18, as shown by block 234. If the E-Stop push button switch 90 is pushed and held down for a preset period of time, this action causes the power to the transmitter circuits to be removed (block 235). Lastly, the position of the transmitter trigger 106 is encoded and the corresponding signals are transmitted to the programmable controller 24 (block 236). In the event that there is a problem with the operation of the trigger 106, the problem is detected by the programmable controller 24, whereupon the error code EC16 is generated and displayed on the visual display 25.

From the foregoing, disclosed is the apparatus and corresponding control thereof for the utilization of a pressure transducer to determine the load conditions on the crane, and the manner in which operator commands can be overridden to prevent damage to the crane or present hazardous conditions to the personnel in the vicinity of the crane. In addition, disclosed is a control system for responding to various ranges of pressures produced by the pressure transducer to control the crane in different ways. Preferably, the pressure transducer is connected to monitor the hydraulic pressure associated with a lift cylinder of the crane. In each different status condition of the crane, there are provided codes displayed to the operator for use in quickly determining the condition of the crane.

While the preferred and other embodiments of the invention have been disclosed with reference to specific crane and control methods and apparatus, it is to be understood that many changes in detail may be made as a matter of engineering choices without departing from the spirit and scope of the invention, as defined by the appended claims.

What is claimed is:

1. A method for controlling the operation of a crane, comprising the steps of:

providing operator controls to allow control of the crane operations by an operator;

using a proportional hydraulic valve to control hydraulic fluid coupled to hydraulic motors that control the crane operations;

periodically monitoring by a control system a hydraulic pressure of a lift mechanism of the crane so as to determine a load condition of the crane;

storing in the control system a plurality of ranges of hydraulic fluid pressures applied to the lift mechanism during various crane operations, including;

a) a first pressure range, b) a second pressure range higher than said first pressure range, and c) a third pressure range higher than said second pressure range;

allowing the crane to be operated by the operator without modification when the monitored hydraulic pressure is in said first range;

using the control system to modify crane operations requested by the operator when the monitored hydraulic pressure is in said second pressure range, including using the control system to control the proportional valve to reduce the hydraulic fluid flow therethrough to slow the movements of the crane operations; and using the control system to deny various crane operations requested by the operator when the monitored hydraulic pressure is in said third pressure range, said various crane operations being denied comprise those crane operations which would increase a moment of a load being lifted by the crane, and said control system allows other crane operations not having an effect of increasing the moment to be carried out when the monitored hydraulic pressure is in said third pressure range.

2. The method of claim 1, wherein said third pressure range comprises an overload range, and further including allowing the operator to raise a boom of the crane, or retract a telescopic boom of the crane or lower the load when the monitored hydraulic pressure is in said third pressure range.

3. The method of claim 1, further including providing a hydraulic valve for controlling a movement of each crane apparatus, and supplying pressurized fluid to said hydraulic valves by way of said proportional valve.

4. The method of claim 1, further including modifying crane operations requested by the operator when the monitored hydraulic pressure is in said second pressure range by modifying the requested speed by which a boom of the crane is lowered.

5. The method of claim 1, further including providing visual readout indications of different operating conditions of the crane as a function of the monitored hydraulic pressure of the lift mechanism.

6. The method of claim 5, further including providing a visual readout of an overload condition of the crane when the hydraulic pressure is monitored and determined by said control system as exceeding a predefined threshold.

7. The method of claim 5, further including providing a first overload readout when a boom of the crane is attempted to be extended or a hoist of the crane is attempted to be activated, and a second overload readout different from said first overload readout when the boom is attempted to be raised or lowered.

8. The method of claim 5, further including providing a visual readout when said hydraulic pressure is sensed to be less than a predefined amount to thereby prevent damage to a boom of the crane should said boom be resting on a support.

9. The method of claim 1, further including providing visual readout indications of different operating conditions of the crane as a function of monitored switch sensors of the crane.

10. The method of claim 9, further including providing a visual readout indicating that a traveling block of the crane has engaged with a crown mechanism of the crane.

11. The method of claim 9, further including providing a visual readout indicating when a boom of the crane is in a predefined position to be stowed for transportation.

12. The method of claim 9, further including monitoring hydraulic pressure of the lift mechanism, and providing a visual indication when the hydraulic pressure and the switch sensors indicate that the crane operations are in a normal range.

13. The method of claim 1, further including:

providing a visual display for displaying status codes, said status codes relating to operational parameters of the crane;

providing said visual display on said crane outside a cab of the crane so as to be visible by an operator using a wireless hand-held transmitter for controlling operation of the crane; and said visual display associated with a listing of the status codes cross-referenced to problems related to a crane boom position or boom load condition.

14. The method of claim 13 further including providing other visual indications to an operator of the crane as to curative steps to take in response to the visual readouts.

15. The method of claim 13, further including;

using the control system to sense hydraulic pressure of a lift cylinder that operates to support a load that the crane is lifting, and said control system provides output load indications as a function of the hydraulic pressure; and sensing sensor switches that sense movements and positions of crane apparatus and providing respective load and position indications of the crane apparatus to said control system.

16. The method of claim 15, further including:

using a programmable processor programmed to process the load indications and the position indications and providing outputs to said visual display for displaying a status of the operations of the crane, whereby when a status code is displayed said operator can consult said listing to determine a probable cause of a problem relating to a position or loading of the crane boom.

* * * * *